US005154410A

United States Patent [19]

Baader et al.

[11] Patent Number: 5,154,410

[45] Date of Patent: Oct. 13, 1992

[54] APPARATUS FOR STRAIGHTENING AND STACKING ENVELOPES FOR PHOTOSENSITIVE MATERIALS

[75] Inventors: Josef Baader, Taufkirchen; Peter Funk, Arget; Rainer Türcke, Taufkirchen; Helmut Zangenfeind, Puchheim; Günter Jubile, Munich, all of Fed. Rep. of Germany

[73] Assignee: AGFA-Gevaert Aktiengesellschaft, Leverkusen, Fed. Rep. of Germany

[21] Appl. No.: 535,304

[22] Filed: Jun. 7, 1990

Related U.S. Application Data

[63] Continuation of Ser. No. 326,330, Mar. 21, 1989, abandoned.

[30] Foreign Application Priority Data

Apr. 2, 1988 [DE] Fed. Rep. of Germany ..... 3811221

[51] Int. Cl.[5] ..... B65H 29/70

[52] U.S. Cl. ..... 271/188; 271/2; 493/399

[58] Field of Search ..... 271/2, 188, 209, 272–274; 493/396, 399, 403, 435

[56] References Cited

U.S. PATENT DOCUMENTS

| | | | |
|---|---|---|---|
| 1,685,873 | 10/1928 | Evans et al. | 271/188 |
| 1,891,286 | 9/1929 | Miersch | 271/188 |
| 2,843,377 | 7/1958 | Battersby | 271/188 |
| 3,044,772 | 7/1962 | Trenner | 271/188 X |
| 3,052,467 | 9/1962 | Fertig | 271/188 |
| 3,415,509 | 12/1968 | Tyburski | 271/188 X |
| 3,550,935 | 12/1970 | Smith et al. | 271/188 |
| 3,632,107 | 1/1972 | Rehm | 271/188 |
| 3,749,398 | 7/1973 | Fujita et al. | 271/180 |
| 4,019,640 | 4/1977 | Marin et al. | 271/209 X |
| 4,154,046 | 5/1979 | Weber et al. . | |
| 4,214,740 | 7/1980 | Acquaviva | 271/188 X |
| 4,236,856 | 12/1980 | Mol et al. | 271/207 X |
| 4,359,217 | 11/1982 | Roller et al. | 271/188 X |
| 4,359,218 | 11/1982 | Karis | 271/188 |
| 4,500,085 | 2/1985 | Rayfield et al. | 271/207 |
| 4,508,224 | 4/1985 | Weber et al. . | |
| 4,577,852 | 3/1986 | Grunder | 271/188 |
| 4,619,452 | 10/1986 | Euteneuer et al. | 271/209 X |
| 4,621,970 | 11/1986 | Würfel et al. . | |
| 4,643,371 | 2/1987 | Würfel et al. . | |
| 4,732,278 | 3/1988 | Zangenfeind et al. . | |
| 4,732,375 | 3/1988 | Tetherton | 271/188 X |

FOREIGN PATENT DOCUMENTS

| | | | |
|---|---|---|---|
| 56-12251 | 2/1981 | Japan . | |
| 0089555 | 5/1983 | Japan | 271/188 |
| 0007659 | 1/1984 | Japan | 271/213 |
| 0248852 | 11/1986 | Japan | 271/188 |
| 0012569 | 1/1987 | Japan | 271/188 |
| 00411347 | 2/1988 | Japan | 271/188 |
| 0185768 | 8/1988 | Japan | 271/188 |
| 1439268 | 6/1976 | United Kingdom | 271/188 |

*Primary Examiner*—Robert P. Olszewski
*Assistant Examiner*—Boris Milef
*Attorney, Agent, or Firm*—Peter K. Kontler

[57] ABSTRACT

Envelopes which are about to receive developed photographic films and/or prints are advanced toward a stacking station in a predetermined orientation and each envelope is provided with one or more fold lines extending in the direction of advancement of envelopes. The fold lines serve to straighten the envelopes which are delivered in rolled, creased and/or otherwise deformed condition such as could interfere with predictable stacking of envelopes in a predetermined sequence which is necessary to ensure that each envelope receive a proper set of film frames and/or prints for shipment or delivery to the parties whose names and/or addresses appear on the envelopes. The fold lines straighten the originally deformed envelopes (which are in random distribution with non-deformed envelopes) for an interval of time which suffices to ensure proper stacking, even if the envelopes exhibit a pronounced tendency to reassume their deformed state. A properly stacked straightened (originally deformed) envelope is normally prevented from reassuming its deformed state by the weight of envelopes which are deposited above it.

8 Claims, 3 Drawing Sheets

APPARATUS FOR STRAIGHTENING AND STACKING ENVELOPES FOR PHOTOSENSITIVE MATERIALS

This application is a continuation of application Ser. No. 326,330, filed Mar. 21, 1989 now abandoned.

BACKGROUND OF THE INVENTION

The invention relates to apparatus for manipulating envelopes (also called pockets) for photosensitive materials of various kinds, such as unexposed or exposed photographic roll films in cassettes, strips of exposed photographic roll films and/or prints with images of exposed and developed film frames on developed photographic paper.

A cassette containing exposed but undeveloped roll film is normally placed into an envelope, either by the photographer or by the dealer or in another establishment which collects exposed customer films for shipment or delivery to a photographic processing laboratory. An envelope is normally assembled of two sheets which consist of paper or plastic material and are connected to each other at three of their four edges to form a pocket having an open side and one or more compartments for reception of cassettes or strips of exposed film frames and/or prints. One of the sheets transmits light so that it is possible to ascertain the type and/or other characteristics of the cassette and/or the film therein while the cassette remains in the envelope. The establishment (such as a dealer in photographic equipment, a drug store, a corner store or a department store) delivers or ships large numbers of envelopes to a processing laboratory wherein a person in charge removes the cassettes from the envelopes and admits the cassettes, in a given sequence, into an apparatus which is designed to remove exposed but undeveloped films from the cassettes and to process the films in a number of ways. Reference may be had, for example, to commonly owned U.S. Pats. Nos. 4,154,046, 4,621,970, 4,643,371 and 4,732,278. The processing can include splicing successive films end-to-end to form a long series of coherent films, convoluting the long series of films onto a core, transferring the resulting roll into a developing machine, transferring the developed films into a copying machine which reproduces the images of film frames onto a web of photographic paper, subdividing the copied films into strips each of which contains a selected number (e.g., six) of coherent film frames, subdividing the web of exposed photographic paper into discrete prints, and gathering the strips of film frames and the corresponding prints for insertion into the respective envelopes.

Insertion can be achieved if the envelopes are properly manipulated subsequent to removal of cassettes and preparatory to introduction of corresponding strips of film frames and prints for shipment or delivery back to a collecting establishment or directly to the customers. The manipulation of envelopes involves manual introduction into an imprinting mechanism or another suitable mechanism wherein the envelopes are provided with information (such as serial numbers) prior or subsequent to reaching a transporting system which delivers the imprinted envelopes to a stacker. It is customary to design the transporting mechanism in such a way that a sensor monitors the arrival of the leading edge of an envelope into a predetermined portion of the path for successive envelopes and sets in motion a drive for at least one of a set of advancing rolls which define a nip for successive envelopes. The stacker can include a box which receives envelopes downstream of the imprinting mechanism.

It is important to ensure that the envelopes are manipulated in a predetermined sequence, i.e., in such a way that the attendants or an automatic machine can introduce strips of developed film frames and prints of images on such frames into proper envelopes for delivery or shipment back to the establishment which has shipped the respective cassettes, or directly back to the customers. Improper manipulation of a single envelope can result in shipment of a large number of strips of film frames and prints to wrong parties with resulting inconveniences and expenses. In other words, the stacker must accumulate imprinted empty envelopes in a given sequence. Each envelope bears the name and address of the establishment (e.g., a dealer) or of the customer, and each envelope can bear additional information which is important to the party or establishment receiving the envelopes with strips of film frames and prints, namely the cost of developing the films, the cost of making the prints and/or other data.

Attempts to avoid shipment of envelopes with developed films and prints to wrong parties include the application of identical serial numbers to splices at the leading or trailing ends of successive films of a long series of films and to the corresponding envelopes. Problems arise when the envelopes reach the processing laboratory in deformed condition. For example, many dealers or other establishments for collection of cassettes with exposed but undeveloped roll films preparatory to shipment or delivery to a laboratory prefer to drape the envelopes around the respective cassettes and to apply rubber bands around the resulting packages. This invariably results in pronounced deformation of the envelopes.

Many other envelopes are deformed during introduction into and/or during confinement in a bag or pouch wherein they are stored with many other envelopes for shipment or delivery to the processing laboratory. The neighboring envelopes and their contents (as well as the panels of a bag or pouch) are likely to bend, crease and/or otherwise deform at least some of the confined envelopes.

A deformed envelope is smoothed by hand in order to ensure proper introduction into the imprinting mechanism. If the envelopes are automatically transported to the stacker, they must reach the stacking station in a condition suitable for proper piling up of successive envelopes on top of each other, i.e., for ensuring that the sequence of envelopes in a full stack is the same as the sequence of corresponding films in the long series of films which are spliced together end-to-end for transport through the developing and copying machines. However, it happens again and again that a strongly deformed (e.g., convoluted) envelope will tend to reassume its deformed state as soon as, or even before, it reaches the stacking station where it interferes with proper stacking of next-following undeformed or less deformed envelopes. Similar problems are encountered with envelopes which exhibit pronounced pleats, creases, undulations and/or other undesirable formations which are likely or actually certain to interfere with proper stacking of successively imprinted envelopes. It can even happen that a next-following envelope slides beneath a previously admitted convoluted envelope to thus scramble the sequence of envelopes with the resulting inconveniences and expenses. This will be readily appreciated by bearing in mind that a convoluted envelope can roll on top of the stack of properly piled up envelopes beneath it and enables an oncoming envelope slip beneath the convoluted envelope. In addition, if several successive envelopes enter the stacker in the form of rolls, they are likely to prevent further stacking of envelopes in any sequence.

An object of the invention is to provide a novel and improved apparatus for manipulating deformed and non-deformed envelopes for photosensitive material, particularly in a photographic processing laboratory.

A further object of the invention is to provide the apparatus which novel and improved means for treating deformed and non-deformed envelopes prior to stacking.

An additional object of the invention is to provide the apparatus with novel and improved means for advancing envelopes which are about to receive photosensitive material in a processing laboratory.

A further object of the invention is to provide an apparatus which can be incorporated into existing machines in a processing laboratory to reduce the likelihood of scrambling of the envelopes which are being prepared for reception of developed film frames and/or photographic prints.

Another object of the invention is to provide the apparatus with novel and improved means for reinforcing selected portions of deformable envelopes.

SUMMARY OF THE INVENTION

The invention resides in the provision of an apparatus for manipulating a series of deformable envelopes, particularly pockets for confinement of photosensitive material, wherein deformed and non-deformed envelopes are in random distribution. The apparatus comprises drive means which is operable to advance the envelopes of the series in a predetermined orientation in a predetermined direction along a predetermined path, and straightening means for providing each envelopes with at least one reinforced or stiffened portion (hereinafter called fold line) which extends in the predetermined direction and is sufficiently pronounced to at least temporarily reduce or eliminate deformation of originally deformed envelopes.

The apparatus preferably further comprises means (such as a suitably configurated and dimensioned tray or box) for stacking the envelopes of the series in a second portion of the path downstream of the predetermined portion (as seen in the predetermined direction) in the same sequence in which the envelopes are provided with fold lines in the predetermined portion of the path.

The apparatus can further comprise a printer or other suitable means for applying to the envelopes of the series information or indicia (such as serial numbers) in a further portion of the path. Such further portion is or can be located upstream of the predetermined portion.

The apparatus can also comprise means for monitoring the path for the presence of envelopes, and such monitoring means can include means for operating (or for initiating the operation of) the drive means in response to detection of envelopes, i.e., the drive means need not be in operation when the supply of envelopes in the path is exhausted.

The drive means can include at least one first rotary advancing member (e.g., a first roll) at one side of the path and at least one second rotary advancing member (e.g., a second roll) at the other side of the path substantially opposite the first member. The advancing members define a nip for the envelopes of the series, and the straightening means can form part of the advancing members. Thus, the straightening means can comprise a recess in the periphery of one of the advancing rolls and a projection at the periphery of the other advancing roll. The projection is aligned with the recess, and the one advancing roll (with the recess in its periphery) is preferably disposed at a level below the other advancing roll. The projection can comprise a circumferentially complete annular rib or bead, and the recess can include a circumferentially complete annular groove. The width of the groove preferably at least equals the width of the bead (as measured in the axial direction of the rolls), and the depth of the groove (as measured radially of the one roll) at least equals or exceeds the height of the bead (as measured radially of the other roll). The cross-section of the bead preferably resembles an equilateral triangle with a base having a width of not less than 2 mm and an apex angle (opposite the base) of 120°-140°, preferably close to 130°. The bead can be provided with a rounded ridge in the region of the apex angle. At least the bead of the other roll can contain or consist of hard polyvinyl chloride.

Alternatively, the straightening means can comprise means for bending the envelopes between the nip of the advancing rolls and one marginal portion of each envelope of the series so that a strip-shaped first section of each envelope is bent with reference to a second section which advances through the nip. The straightening means can be designed to bend the first sections of successive envelopes of the series to positions substantially at right angles to the respective second sections. The bending means of the straightening means can include a roller which is coaxial with one of the advancing rolls and has a diameter exceeding that of the one advancing roll by at least 3d wherein d is the thickness of an envelope. The drive means of such apparatus preferably comprises a shaft or other suitable means for rotating the one advancing roll and the roller of the bending means about their common axis. The bending roller can consist, of or can contain rubber with a shore hardness of approximately 80. The distance of the nip from the bending roller (i.e., the axial distance between the bending roller and the one advancing roll) is or can be such that the width of the second section of each envelope is at least five times the width of the respective first section.

The novel features which are considered as characteristic of the invention are set forth in particular in the appended claims. The improved apparatus itself, however, both as to it construction and its mode of operation, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
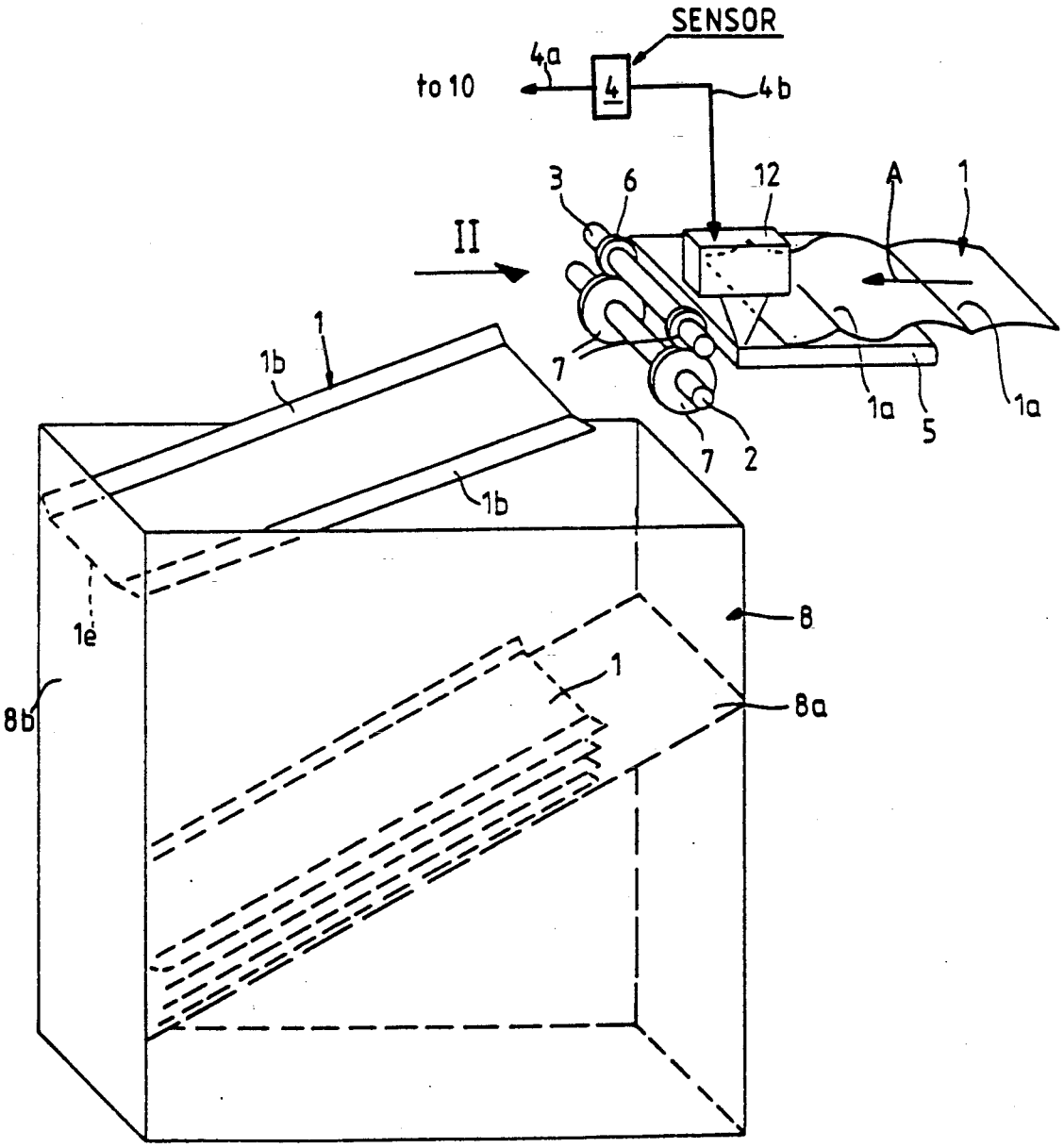
FIG. 1 is a schematic perspective view of an apparatus which embodies one form of the invention and comprises means for providing each of a series of envelopes with several fold lines.
Figure 2:
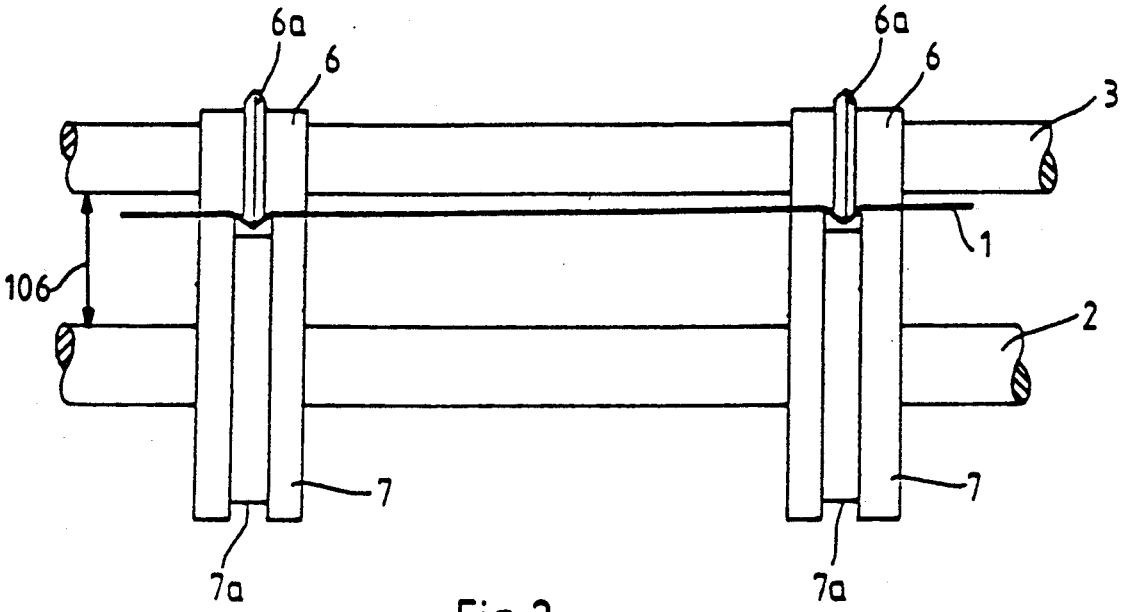
FIG. 2 is an enlarged view of the combined advancing and straightening means, substantially as seen in the direction of arrow II in FIG. 1.

Referring first to FIGS. 1 and 2, there is shown an apparatus which serves to manipulate a series of envelopes 1 which are advanced in the direction of arrow A along a predetermined path defined in part by a platform 5 or a like support for the undersides of successive envelopes of the series. FIG. 1 shows an envelope 1 which is deformed in that it exhibits pronounced creases 1a extending transversely of the direction of its movement along the predetermined path. Such creases can develop as a result of improper handling prior to admission of envelopes 1 into the apparatus of FIGS. 1 and 2, e.g., as a result of packing a large number of envelopes (containing cassettes with exposed but undeveloped films) into a bag, a pouch or a like receptacle. Creases or similar deformations are equally likely to develop if an envelope is draped around the cassette and is secured in convoluted condition by one or more elastic bands.

In addition to the platform or support 5, the apparatus of FIGS. 1 and 2 comprises drive means for advancing successive envelopes 1 of the series along the predetermined path so that the envelopes are caused to advance in the direction of arrow A through the nip of two pairs of rotary members in the form of advancing rolls. The rolls 6 of one pair are disposed at a level above the rolls 7 of the other pair, and the rolls 7 are driven by a shaft 2 which receives motion from a prime mover 10 (FIG. 4) through the medium of a belt or chain transmission 11. The rolls 6 are mounted on a second shaft 3 and are rotated by an envelope 1 which has entered the nip of the rolls 6 and 7

A sensor 4 is provided to detect the leading edge 1e of an envelope 1 in the nip of the rolls 6, 7 and to generate a signal which is transmitted to the controls for the motor 10 by way of conductor means 4a so that the motor is started and rotates the shaft 2 until the trailing end of the envelope 1 advances beyond the nip. The sensor 4 ensures that the advancing rolls 6 and 7 are caused to rotate only when an envelope 1 is properly oriented in its path for engagement by the straightening means.

The platform 5 is disposed beneath an imprinting mechanism 12 of any known design which applies information (e.g., serial numbers) to successive envelopes 1 of the series of envelopes advancing toward and along the platform on their way into the nip of the rolls 6 and 7. The mechanism 12 receives signals from the sensor 4 (via conductor means 4b) or from the motor 10 to apply to each envelope 1 information in a predetermined location. If the information consists of a serial number, the number is the same as that applied to adhesive strips serving to splice successive films of a long series of spliced-together exposed but undeveloped photographic roll films preparatory to transfer of the resulting composite strip of films into a developing machine. The information which is applied by the mechanism 12 can be in the form of numerals, letters, bar code or any other encoded information which can be decoded by a reader.

Envelopes 1 which have moved beyond the advancing rolls 6 and 7 are caused to descend into a stacking receptacle in the form of a box 8 having a preferably forwardly and downwardly sloping bottom wall 8a which accumulates a stack of superimposed envelopes in the same sequence in which the envelopes are delivered (e.g., by hand) into the nip of the advancing rolls 6 and 7. The inclination of the bottom wall 8a of the stacking box 8 to the horizontal can be zero or up to 30°. The speed of the shaft 2 can be selected in such a way that successive envelopes 1 which leave the nip of the rolls 6 and 7 are propelled in the direction of arrow A at a speed which suffices to ensure that the leading edges 1e strike the wall 8b and descend onto the bottom wall 8a or onto the growing stack of envelopes on the bottom wall.

FIG. 2 shows that the means for straightening successive envelopes (irrespective of whether the envelopes are delivered in deformed or non-deformed condition) is incorporated into the drive means, namely into the advancing rolls 6 and 7. Such straightening means includes recesses in the form of circumferentially complete grooves 7a which are provided in the peripheral surfaces of the advancing rolls 7, and projections in the form of circumferentially complete ribs or beads 6a provided at the peripheries of the advancing rolls 6 in register with the respective grooves 7a. The cross-section of each bead 6a is an equilateral triangle with a base having a width of at least 2 mm (as measured in the axial direction of the rolls 7) and an apex angle of 120°–140°, preferably close to 130°. The height of each bead 6a (as measured in the radial direction of the respective roll 6) at most equals the depth of the respective groove 7a, and the width of each groove 7a (as measured axially of the respective roll 7) at least equals the width of the base of the corresponding bead 6a.

The ridges of the beads 6a (these ridges are adjacent the apex angles of the beads) are preferably rounded. At least the beads 6a of the rolls 6 can be made of hard polyvinyl chloride. The driven rolls 7 can be made of soft rubber to enhance frictional engagement with the envelopes 1 in the nip of the rolls 6, 7 and predictable advancement of envelopes in the direction of arrow A. As can be seen in FIG. 2, each groove 7a is dimensioned in such a way that it can fully receive the adjacent (lowermost) portion of the registering bead 6a.

An envelope 1 which has been caused to advance through the nip of the rolls 6 and 7 is provided with two parallel fold lines 1f (FIG. 3) which are adjacent the respective marginal portions 1m of the envelopes. The fold lines 1f can be said to constitute hinges along which the relatively narrow strip-shaped outer sections 1b of the envelopes are flexed or pivoted relative to the wider central sections or panels 1g. The width of each section 1b can equal or approximate one-sixth of the overall width of an envelope 1 between the marginal portions 1m. The extent to which the sections 1b are pivoted relative to the section 1g can be in the range of up to 10°, preferably about 5°. In other words, the angle between the wide section or panel 1g and a narrower section 1b can be close to 175°.

The extent to which the sections 1b are inclined relative to the section 1g can be altered by changing the distance of the shaft 2 from the shaft 3. The means (such as an eccentric which rotatably surrounds one of the shafts 2, 3 and can be caused to change its angular position in order to permit a movement of the other shaft nearer to the one shaft or to move the other shaft further away from the one shaft) for varying the extent of flexing of sections 1*b* relative to the section 1*g* is indicated by a double-headed arrow 106 It normally suffices to mount the shafts 2 and 3 at a fixed distance from each other.

The fold lines 1*f* reinforce or stiffen the envelopes 1 in the direction of arrow A. Such stiffening is not absolutely necessary for satisfactory (nondeformed) envelopes 1 but is beneficial for proper stacking of envelopes which enter the nip of the rolls 6, 7 in proper orientation (with the marginal portions 1*m* parallel to the direction which is indicated by the arrow A) but are convoluted or provided with transversely extending creases 1*a*, pleates or other undesirable deformations which would be likely or certain to prevent predictable stacking of such envelopes in the box 8. The fold lines 1*f* are sufficiently pronounced to ensure that an originally deformed envelope 1 will be straightened out for a certain interval of time (even if the envelope exhibits a pronounced tendency to reassume its deformed state) which is required to propel the envelope into the box 8. It is preferred to select the straightening action of the beads 6*a* in such a way that a straightened envelope 1 (i.e., an originally deformed envelope) retains the shape which is imparted thereto during travel through the nip of the rolls 6, 7 for an interval of time which suffices to ensure that the envelope enters the box 8 as well as that the drive means delivers one or more additional envelopes which rest on top of the originally deformed envelope and thus prevent the originally deformed envelope from reassuming its deformed condition. This guarantees that the envelopes are invariably stacked in the sequence in which they enter the nip of the rolls 6 and 7 in spite of a very pronounced tendency of certain originally deformed envelopes to reassume their deformed state. Therefore, the envelopes which form the stack in the box 8 can be processed by automatic machines to receive proper film frames and proper prints, i.e., film frames and prints belonging to the party whose name and/or address appears on the envelope. Furthermore, the stack of envelopes 1 in the box 8 grows at a predictable rate, and its configuration is best suited for transfer to the locus for reception of photosensitive material.

Figure 3:
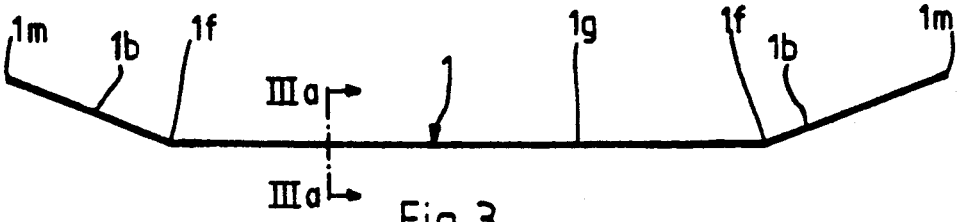
FIG. 3 is an enlarged transverse sectional view of an envelope subsequent to treatment in the apparatus of FIG. 1.
Figure 3A:
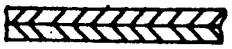
FIG. 3a is an enlarged fragmentary sectional view as seen in the direction of arrows from the line IIa–IIIa in FIG. 3.

As mentioned above, the extent to which the narrower sections 1*b* of a straightened envelope 1 are pivoted relative to the wider median section or panel 1*g* need not exceed 5°. This ensures that a stack containing a predetermined number of envelopes 1 having fold lines 1*f* of the type shown in FIG. 3 is not much higher than a stack containing the same number of ideal (entirely flat) envelopes. In addition, the fold lines 1*f* do not interfere with the application of additional information (such as the cost of developing and the cost of making prints) and/or with the introduction of strips of film frames and/or photographic prints.

The imprinting mechanism 12 can be installed downstream of the nip of the rolls 6 and 7 without departing from the spirit of the invention.

Figure 4:
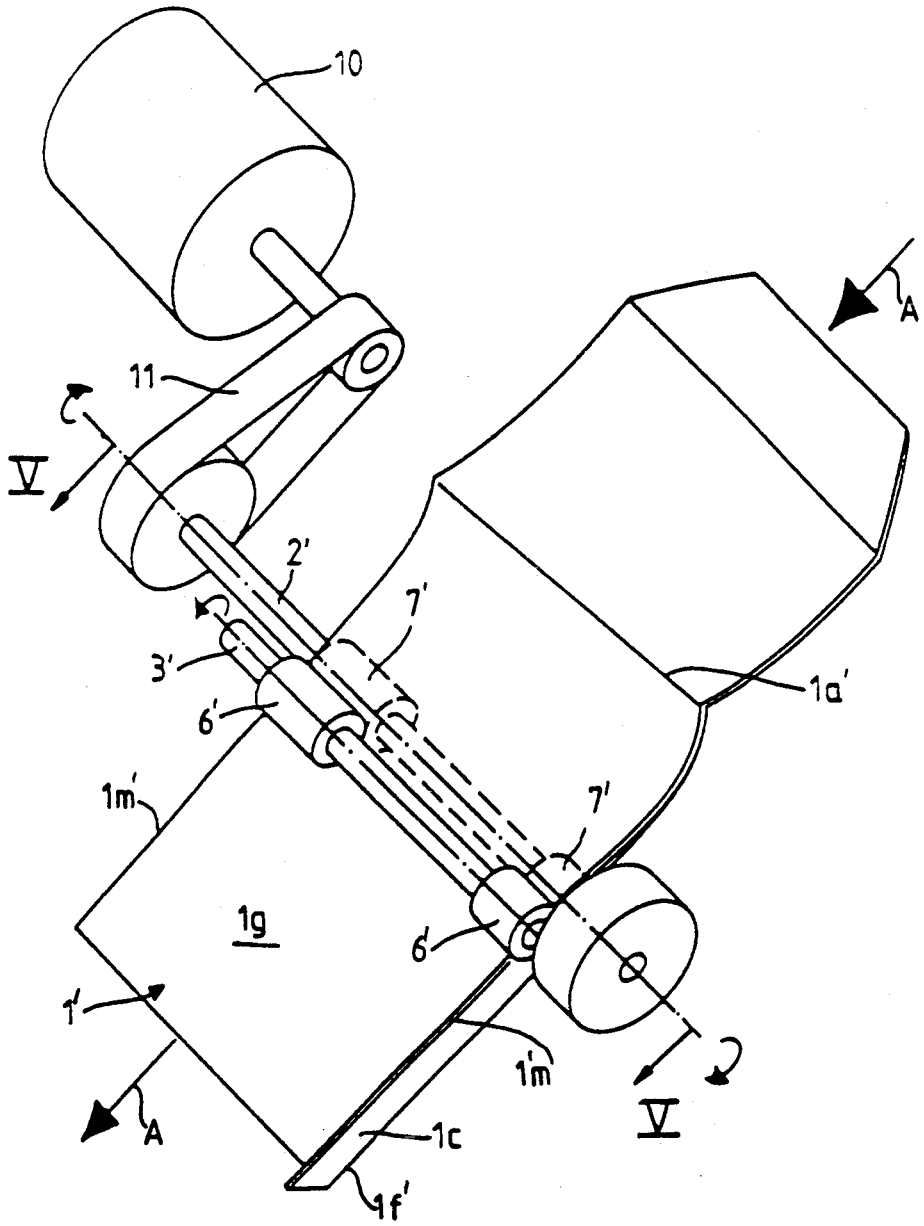
FIG. 4 is a fragmentary schematic perspective view of a modified apparatus which is designed to provide each envelope with a single fold line.
Figure 5:
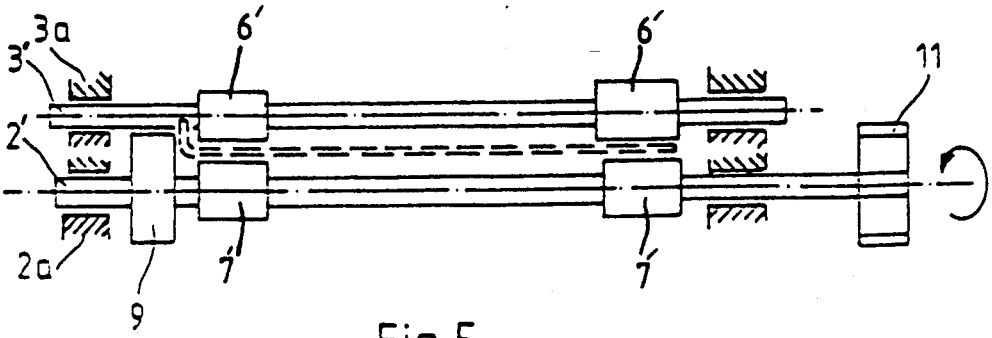
FIG. 5 is a sectional view substantially as seen in the direction of arrows from the line V—V of FIG. 4.

FIGS. 4 and 5 show a portion of a modified apparatus wherein all such parts which are identical with or clearly analogous to corresponding parts of the apparatus of FIGS. 1–2 are denoted by similar reference characters each followed by a prime. The main difference between the two apparatus is that the apparatus of FIGS. 4–5 has a straightening means designed to provide each envelope 1' with a single fold line 1*f'*, i.e., each envelope which advances beyond the nip of the rolls 6' and 7' includes a narrow section 1*c* between one marginal portion 1*m'* and the fold line 1*f'*, and a wide section extending from the fold line 1*f'* to the other marginal portion 1*m'*. The straightening means is preferably designed to bend or pivot the narrower section 1*c* through an angle of approximately 90°. Such straightening means includes a roller 9 which is adjacent but spaced apart from the nip defined by the rolls 6', 7' and has a diameter which exceeds the diameter of the rolls 7' by not less than 3*d* wherein d is the thickness of an envelope 1'. The roller 9 is mounted on the shaft 2' for the rolls 7' and can be made of hard polyvinyl chloride. The shafts 2' and 3' are rotatable in bearings 2*a* and 3*a*, respectively. The mutual spacing of the roller 9 and the adjacent roll 7' (as measured in the axial direction of the shaft 2') should not, or need not, be less than 5*d*. The roller 9 can have a shore hardness of 80.

The bent-over sections 1*c* do not interfere with proper stacking of straightened envelopes 1' in a box or the like (not shown in FIGS. 4 and 5). The overall height of a stack of envelopes 1' which are straightened out in a manner as shown in FIG. 4 need not exceed the overall height of a stack containing the same number of ideal (absolutely flat) envelopes except that the sections 1*c* of several topmost envelopes extend above the section 1*g'* of the topmost envelope. Furthermore, the strip-shaped sections 1*c* will cause a slight lateral shifting of superimposed envelopes relative to each other.

The improved apparatus is susceptible of many additional modifications. For example, a first set of rolls (such as 6' and 7') can be used to advance successive envelopes along their path toward a stacking station, and a second set of rolls (such as 6, 7) can be used to straighten the envelopes on their way toward the stacking station. It is also possible to employ endless belt conveyors as a means for advancing the envelopes toward the stacking station and to design the pulleys for such belt conveyors in a manner to cooperate with straightening elements in order to provide each envelope with at least one fold line. For example, at least one pulley can have a groove 7*a* and then cooperates with a roll having a bead 6. Alternatively, at least one pulley can be mounted coaxially with a roller corresponding to the roller 9 of FIGS. 4 and 5.

All that counts is to provide the apparatus with straightening means which ensures that the envelopes are reinforced in the direction of their advancement toward the stacker in order to guarantee that the shape of the envelopes will not change during propulsion from the nip of the advancing means into the stacking box, and preferably that the straightened (originally deformed) envelopes will retain the desired shape until they are located within (rather than on top of) the growing stack so that the envelopes above them oppose their tendency to reassume the original (deformed) condition. Each envelope can be said to constitute a straight projectile which travels in a predictable manner from the drive means toward and into the stacking means.

Envelopes which can be straightened in accordance with the method and in the apparatus of the present invention are or can be of the type disclosed in U.S. Pat. No. 4,508,224.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the aforedescribed contribution to the art and, therefore, such adaptations should and are intended to be comprehended within the meaning and range of equivalence of the appended claims.

What is claimed is:

1. Apparatus for manipulating a series of deformable envelopes for confinement of photosensitive material wherein deformed and non-deformed envelopes are in random distribution and wherein a first sheet consisting of a first material overlies a second sheet consisting at least in part of a different second material, comprising drive means operable to advance the envelopes of the series in a predetermined orientation in a predetermined direction along a predetermined path, including at least one first rotary advancing member at one side and at least one second rotary advancing member at the other side of said path substantially opposite said first advancing member, said advancing members defining a nip for the envelopes of the series; straightening means for providing each envelope of the series in a first portion of said path with at least one fold line which extends in said direction and is sufficiently pronounced to at least temporarily reduce or eliminate deformation of deformed envelopes, said straightening means forming part of said advancing members and including a recess in the periphery of one of said members and a registering projection at the periphery of the other of said members; means for applying to successive envelopes of the series information, such as serial numbers, in a second portion of said path upstream of and close to said first portion; and means for stacking the envelopes downstream of the first portion of said path in the same sequence in which the envelopes are provided with information by said information applying means, including a receptacle having an inclined bottom wall arranged to support the foremost envelope of the series.

2. The apparatus of claim 1, further comprising means for monitoring said path for the presence of envelopes, including means for operating said drive means in response to detection of envelopes.

3. The apparatus of claim 1, wherein said other member is disposed at a level above said one member.

4. The apparatus of claim 1, wherein said projection includes a circumferentially complete annular bead and said recess includes a circumferentially complete annular groove, said bead having a predetermined width and a predetermined height, said groove having a width at least matching said predetermined width and a depth at least matching said predetermined height.

5. The apparatus of claim 4, wherein the cross-section of said bead is a substantially equilateral triangle having a base with a width of at least 2 mm and an apex angle of 120°–140° opposite said base.

6. The apparatus of 5, wherein said apex angle is approximately 130°.

7. The apparatus of claim 5, wherein said bead has a rounded ridge in the region of the apex angle.

8. The apparatus of claim 5, wherein said bead contains or consists of hard polyvinyl chloride.

* * * * *